US005794429A

United States Patent [19]

Overstrass et al.

[11] Patent Number: 5,794,429

[45] Date of Patent: Aug. 18, 1998

[54] YARN FRICTION FALSE TWISTING APPARATUS

[75] Inventors: Detlev Overstrass, Velbert; Hellmut Lorenz, Remscheid, both of Germany

[73] Assignee: Barmag AG, Remscheid, Germany

[21] Appl. No.: 651,521

[22] Filed: May 22, 1996

[30] Foreign Application Priority Data

May 23, 1995 [DE] Germany ..... 195 18 941.8

[51] Int. Cl.[6] ..... D01H 1/24; D01H 7/46

[52] U.S. Cl. ..... 57/339; 57/104; 57/348

[58] Field of Search ..... 57/337, 338, 339, 57/104, 105, 348, 349

[56] References Cited

U.S. PATENT DOCUMENTS

| | | | |
|---|---|---|---|
| 3,813,868 | 6/1974 | Lorenz | 57/77.4 |
| 4,047,374 | 9/1977 | Venot | 57/348 |
| 4,060,967 | 12/1977 | Lorenz | 57/77.45 |
| 4,226,080 | 10/1980 | Bieber et al. | 57/339 |
| 4,297,837 | 11/1981 | Bauer et al. | 57/350 |
| 4,489,546 | 12/1984 | Schuster et al. | 57/339 |
| 5,255,503 | 10/1993 | Rader et al. | 57/339 |
| 5,414,989 | 5/1995 | Rader et al. | 57/348 |

FOREIGN PATENT DOCUMENTS

| | | |
|---|---|---|
| 1 222 826 | 8/1966 | Germany . |
| 26 12 023 | 8/1977 | Germany . |
| 26 07 290 | 9/1977 | Germany . |
| 29 36 845 | 4/1981 | Germany . |
| 41 10 464 | 1/1992 | Germany . |
| 2 212 176 | 12/1988 | United Kingdom . |
| 2 254 342 | 3/1992 | United Kingdom . |

*Primary Examiner*—William Stryjewski

*Attorney, Agent, or Firm*—Bell Seltzer Intellectual Property Law Group of Alston & Bird llp

[57] ABSTRACT

A yarn false twisting apparatus which comprises a drive motor and a yarn false twist assembly, both mounted on a base frame. The yarn false twist assembly comprises a plurality of spindles mounting friction disks which are rotated in the same direction by the motor, and the assembly is releasably mounted to the base frame so it can be separated from the base frame by withdrawing the assembly in an axial direction. The drive motor has a drive pulley, and at least one of the spindles has a belt pulley, which can be interconnected via a drive belt. The drive belt is arranged in a drawer-like housing, which is displaceable in the operating plane of the drive belt. At its free end, the belt pulley mounts a cone, which ensures that the drive belt slides onto the belt pulley when mounting the false twist assembly to the base frame.

22 Claims, 5 Drawing Sheets

YARN FRICTION FALSE TWISTING APPARATUS

BACKGROUND OF THE INVENTION

The present invention relates to an improved yarn friction false twisting apparatus of the type used in the false twist texturing of synthetic thermoplastic yarn.

Friction false twisting apparatus of differing constructions are known. For example, DE 41 10 464 A1 and corresponding U.S. Pat. No. 5,255,503 disclose a false twisting apparatus, which is driven via a toothed belt by an externally arranged motor. In this prior design, the actual false twist unit is arranged on a support or a rotatable base plate, which can be moved by an adjusting lever in the direction toward the motor that is rigidly mounted on a spindle rail, so that the actual friction false twist unit is movable relative to the drive motor by providing an additional mechanism. This additional mechanism allows to disengage the toothed belt, thereby permitting the friction false twist unit to be raised from the machine.

Known from DE 26 12 023 A1 discloses a friction false twist unit, in which the friction unit is mounted on a support plate. The drive of the friction unit, which has shafts provided with friction disks, occurs in this arrangement by a centrally arranged belt drive, which permits the unit to be pivoted thereinto selectively.

DE 29 36 845 A1 discloses a friction false twisting apparatus, in which the shafts carrying the friction disks are provided, on the one hand, with a fixed bearing in a baseplate. On the other hand, they are supported in a bearing plate, which is arranged for displacement over the free ends of the shafts. To this end, the bearings arranged in the bearing plate are mounted, so as to be freely movable in an axial direction and so as to exhibit little radial vibration.

Common to both known false twist units is that the base plate which accommodates both the actual friction false twist unit and the drive motor are of a relatively complicated construction, thus expensive. Since current false twist units operate generally at speeds of 12,000–15,000 rpm and higher, the drive belts are subjected to rapid wear, and their frequent exchange becomes a significant cost factor.

Further known from DE-OS 26 07 290 is a texturing machine operating by the friction false twist principle. In this machine, the friction false twist unit consists likewise of friction disks rotating in the same direction, with their axes being arranged parallel to one another around the advancing yarn. In this false twist unit, the friction disks of the false twist unit are each designed and constructed as a part of the rotor of an electric motor, so that the false twist units operate without a drive belt for driving all three shafts. However, each individual shaft requires a separate electric motor. The essential disadvantage of such an arrangement is that the provision of respectively one separate electric motor for each shaft carrying friction disks brings, among other things, higher demands with respect to the control of all three electric motors. To be able to perform certain repair, such a friction false twist unit requires that the entire unit be removed together with the respective drive from a housing accommodating the electric motors for the friction disk shafts.

It is accordingly an object of the present invention to provide a false twist apparatus, which allows to make use of the advantages of separating the drive and the actual false twist unit, but which do not require pivoting the false twist unit for purposes of inserting or removing the drive belt for the shafts of the friction disks.

SUMMARY OF THE INVENTION

The above and other objects and advantages of the present invention are achieved by the provision of a yarn false twisting apparatus which comprises a base frame, a drive motor mounted to the base frame and including an output shaft which defines an output shaft axis, and a yarn false twist assembly mounted to the base frame. The yarn false twist assembly comprises a bearing block, and at least three spindles mounted to the bearing block for rotation about parallel axes which are positioned at the corner points of an equilateral polygon having a number of sides corresponding to the number of spindles. A plurality of circular disks are mounted on each spindle for rotation therewith, and with the disks of the spindles overlapping at a point centrally between the spindles and defining an operative yarn path of travel extending axially therebetween. The false twist assembly is releasably mounted to the base frame at a fixed distance from said output shaft axis and so that the axes of the spindles are parallel to the output shaft axis. Preferably, this mounting arrangement includes at least one elongate pin fixed to the base frame, and an elongate opening in the bearing block of the yarn false twist assembly which slideably receives the pin. Thus the yarn false twist assembly may be separated from the base frame by withdrawing the assembly in a direction parallel to the spindles.

A drive transmission is provided which includes a drive belt operatively connecting the output shaft of the drive motor to each of the spindles of the yarn false twist assembly so that the drive motor is able to rotate all of the spindles in the same direction. Also, the drive transmission is disconnectable so as to permit the yarn false twist assembly to be removed from the base frame to facilitate the removal and replacement of the drive belt. The drive transmission preferably comprises a motor drive pulley mounted on the output shaft of the motor, a belt pulley mounted on one of the spindles of the yarn false twist assembly, and with the drive belt being operatively interconnected about the motor drive pulley and the belt pulley.

To facilitate the mounting of the yarn false twist assembly and, thus, the insertion of the belt pulley into the operating plane of the drive belt, the belt pulley is provided at its free end preferably with a cone, the diameter of which narrows from the belt pulley. When mounting the yarn false twist assembly, the cone causes the drive belt to slide thereover in a direction toward the belt pulley. During the subsequent startup, the drive belt slips automatically in place on the belt pulley. To facilitate primarily a pivoting of the yarn false twist assembly when mounting or removing or exchanging a drive belt, the drive belt in accordance with the invention is arranged in a drawer-like housing, which is displaceable in the operating plane of the drive belt.

One advantage of such a drawer-like housing is that it is no longer necessary to swing out the false twist assembly from its normal position after it is raised with or above the base plate. Instead, after raising the assembly, the housing needs to be displaced only in the direction of the operating plane of the drive belt. As a result, the tension of the drive belt is reduced such that the latter can easily be removed or exchanged without great effort.

To this end, in a preferred embodiment of the invention, the housing is provided with an inclined surface and a shoulder in the region of the motor drive pulley. When inserting the drive belt into the housing drawer, same slides upward along the inclined surface and below the motor drive pulley onto the shoulder. This prevents the drive belt from slipping again downward. Thereafter, by moving the drawer in the opposite direction, i.e., in direction toward the false twist assembly, the drive belt resting on the shoulder is moved toward the motor drive pulley.

In another embodiment, the housing is provided on its upper side and/or its underside with guide members for securing the drive belt in its position while it runs. After the drive belt has moved as a result of the aforesaid movement in the opposite direction of the housing toward the motor drive pulley, the lateral edges of the motor drive pulley come again to lie substantially flush against the upper and lower boundaries of the shoulder. As a result, the drive belt is pulled onto the circumference of the motor drive pulley under tension, i.e., when the cone of the belt pulley passes through the belt on the opposite side of the motor drive pulley.

Preferably, the drive belt is a toothed belt, which engages in a correspondingly adapted tooth system of the motor drive pulley and the belt pulley. To facilitate the mounting of the drive belt on the belt pulley, i.e., to ensure that the drive belt "slides continuously upward" onto the belt pulley, the tooth system extends, in another embodiment, preferably to the cone.

Preferably, the housing may be constructed as a modular unit, so as to be able to use housing modules corresponding to the different sizes of such a false twist assembly. To facilitate the movement of the drawer housing in the operating plane of the drive belt, and to ensure that the housing is in a position, which guarantees the desired tension of the drive belt, a spring is provided which supports the housing on the base plate or the housing frame forming the base plate.

Preferably, the belt pulley is located on one of the three spindles accommodating the friction disks, the rotation of the three spindles in the same direction and at the same speed being ensured by a further belt system, which provides a connection of the drive of the three spindles to each other.

A yarn breakage that may occur during the operation and make it necessary to stop the false twist assembly or reduce its speed considerably, will lead to the problem of having to provide to this end an additional control for the drive motor, or an interruption of the torque transmission from the drive motor to the false twist assembly. Therefore, a clutch, preferably a magnetic clutch, is provided in an advantageous manner between the belt pulley and the spindle drive system. This clutch has at its front ends two magnetized members facing each other with a gap therebetween and with a magnetic polarity alternating in the circumferential direction. This allows to transmit, on the one hand, any necessary slip between the drive and the friction false twist assembly and, on the other hand, a high torque depending on the number of the magnets with alternating polarity that are arranged in the region of the circumference. Moreover, by providing such a magnetic clutch, i.e. a separation of the drive distance between the driven shaft end of the drive motor and the driven friction disk shaft, it is possible to displace the housing for disengaging the drive belt and, thus, to exchange same.

In a further preferred embodiment, it is possible to replace the magnetic clutch with two opposing disks at its front ends and a gap therebetween, two disks located in the same plane with a gap therebetween and with a magnetic polarity alternating in circumferential direction. Such a magnetic clutch will be useful, primarily when a transmission of smaller outputs is needed.

BRIEF DESCRIPTION OF THE DRAWINGS

Further advantages and possible applications of the invention are described in more detail below with reference to the attached drawings, in which.

DETAILED DESCRIPTION OF THE PREFERRED EMBODIMENTS

Figure 1:
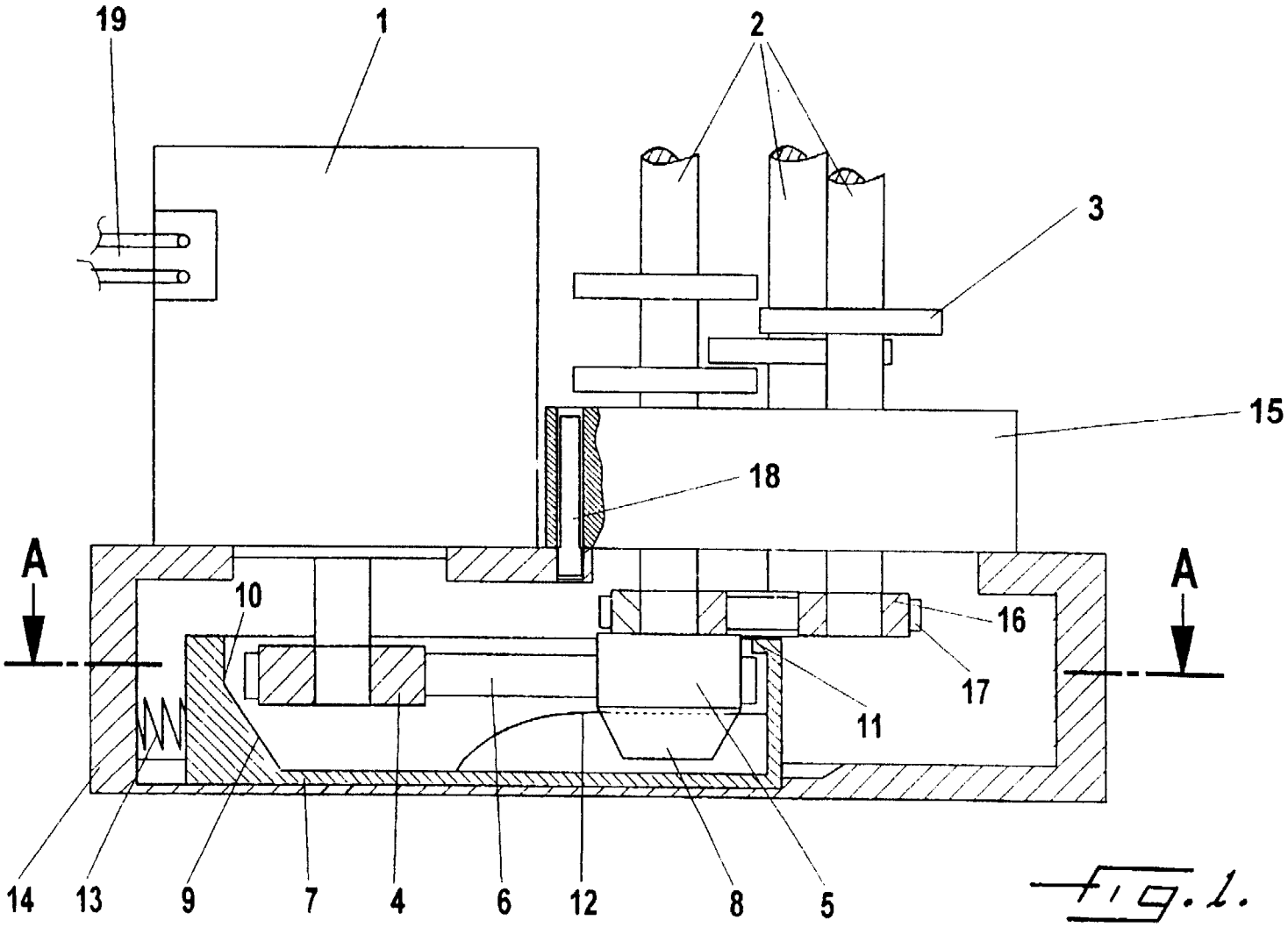
FIG. 1 is a side view, partially sectioned, of a complete false twist apparatus including a drive motor, a yarn false twist assembly, and a base frame, and which embodies the present invention.

A complete false twist apparatus as shown in FIG. 1 comprises a drive motor 1 with electrical connection lines 19. Arranged next to the drive motor on a base frame 14 is a yarn false twist assembly. In the illustrated embodiment, the yarn false twist assembly comprises three spindles 2 which are arranged in the corner points of an equilateral triangle and mounted for rotation in a spindle bearing block 15. The spindles 2 each mount several superposed friction disks 3, one overlapping the other, with the axes of the spindles extending parallel to each other around an advancing yarn. A more complete description of the yarn false twist assembly is set forth in U.S. Pat. No. 3,813,868, the disclosure of which is incorporated herein by reference.

Arranged on the drive shaft of motor 1 is a motor drive pulley 4. In the same plane as the motor drive pulley, one of the three spindles 2 of the yarn false twist assembly mounts a belt pulley 5 on its end extending into the base frame 14. The belt pulley 5 is driven via a drive belt 6, which is also mounted on the motor drive pulley 4. Between belt pulley 5 and spindle bearing block 15, each of the spindles 2 mounts a belt pulley 16. All three belt pulleys 16 extend in the same plane, and the spindles 2 and, thus, the friction disks 3 are rotated in the same direction and at the same speed by a belt 17 looping about the pulleys 16 in a triangle.

For an accurate positioning, two elongate guide pins 18 are provided in the spindle bearing block 15 of the yarn false twist assembly, thus guaranteeing the position of the assembly relative to the drive motor and, consequently, ensuring an optimal tension of the drive belt during the rotation of motor drive pulley 4 and belt pulley 5. Moreover, the guide pins 18 ensure that the false twist assembly does not pivot relative to the base plate, but is removable from the base plate only in the axial direction.

Arranged in the lower region of the base frame 14 is a drawer-like housing 7, which is supported via a spring 13 on base frame 14, so that the drawer-like housing 7 can be displaced in the direction of the operating plane of drive belt 6 against the action of the force exerted by the spring 13.

This housing 7 serves to guide the belt pulley 5 of the false twist assembly through the drive belt 6 in the axial direction. To this end, the belt pulley 5 is provided at its free end with a cone 8. The housing 7 has on its upper side and underside guide members 11 and 12, respectively. On the one hand, these guide members 11, 12 serve to prevent the drive belt 6 from escaping. In addition, the upper guide member 11 serves to slide off and, thus, disengage the drive belt 6 from belt pulley 5 of the driven shaft 2, upon removal of the false twist assembly, which is axially guided by pins 18. After pulling out the false twist assembly, the drive belt 6 remains substantially in its operating plane, by reason of the guide members 11, 12. After removal of the false twist assembly, the housing 7 can be pushed against the action of the force exerted by spring 13 in direction of the operating plane of the drive belt toward drive motor 1, whereby the drive belt tension is released, and the drive belt 6 disengages from the tooth system of motor drive pulley 4. Thus, the drive belt 6 can be easily removed from the housing 7 and be replaced with a new belt, if need arises.

When remounting the false twist assembly, it will suffice to bring drive belt 6 into contact with cone 8. Thereafter, the drive belt 6 slides automatically onto the largest diameter formed by belt pulley 5. The tooth system extends to cone 8. Before the false twist assembly is inserted, it will be necessary to move the housing 7 in the direction toward the motor drive pulley 4 against the action of force of spring 13. As a result, the drive belt 6 assumes a radial gap between the housing 7 and the motor drive pulley 4. For reengaging the belt, the housing 7 is provided with a slope 9 as well as a shoulder 10. When inserting the drive belt 6 into the housing 7, it slides or slips upward along slope 9 and across below motor drive pulley 4 onto shoulder 10. By moving the housing drawer 7 in the opposite direction, i.e., in direction toward the false twist assembly, the drive belt 6 resting on the shoulder is moved toward motor drive pulley 4. In so doing, the edges of motor drive pulley 4 come to lie substantially flush with the upper and lower boundaries of shoulder 10. As a result the drive belt 6 is pulled onto the circumference of motor drive pulley 4 and, thus, into its tooth system, under tension, i.e., when the belt pulley 5 provided with a cone 8 is passed through the operating plane of the drive belt on the opposite side of motor drive pulley 4.

An essential advantage of a false twist unit having such a housing 7 is that it facilitates the exchange of a drive belt 6, which is more often needed in current machines as a result of rapid wear. On the other hand, a further advantage is that the guide members 11, 12 ensure that in operation the drive belt 6 is unable to leave its operating plane even to a slight extent. It is thus guaranteed that the belt runs always over motor drive pulley 4 and belt pulley 5.

Figure 2:
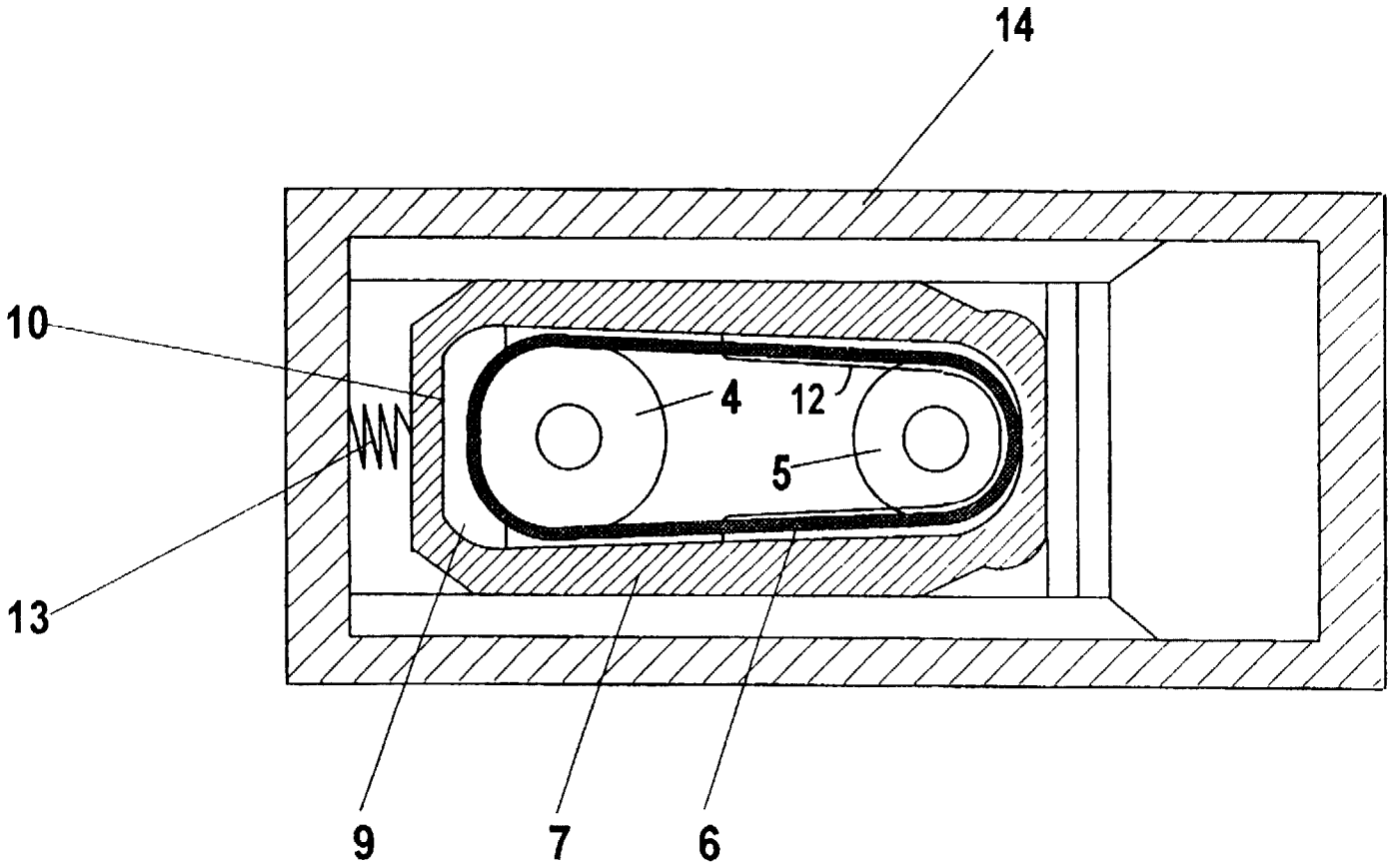
FIG. 2 is a sectional view in the plane A—A shown in FIG. 1.

FIG. 2 is a sectional top view along the plane A—A of FIG. 1. Shown in this sectional view is the housing 7, which accommodates the drive belt 6 with its corresponding guide members. Further shown is that the housing 7 is arranged for longitudinal displacement in the base frame 14 against the force of the spring 13 in the operating plane of drive belt 6. Likewise shown are the inclined surface 9 as well as the shoulder 10. In the sectional view of FIG. 2, the upper guide member 11 of the housing 7 is cut off, whereas it can be noted that on the side of housing 7 facing motor drive pulley 4 an opening is provided, which permits the cone 8 of the belt pulley 5 to pass therethrough. In so doing, the false twist assembly is guided along a straight guideway in the axial direction, i.e., in the direction of insertion. However, this lateral opening in the housing drawer 7 may also be left off. An adequate space in the axial direction of cone 8 on belt pulley 5 will suffice. An opening in the housing 7 is advantageous only for reasons of space.

Figure 3:
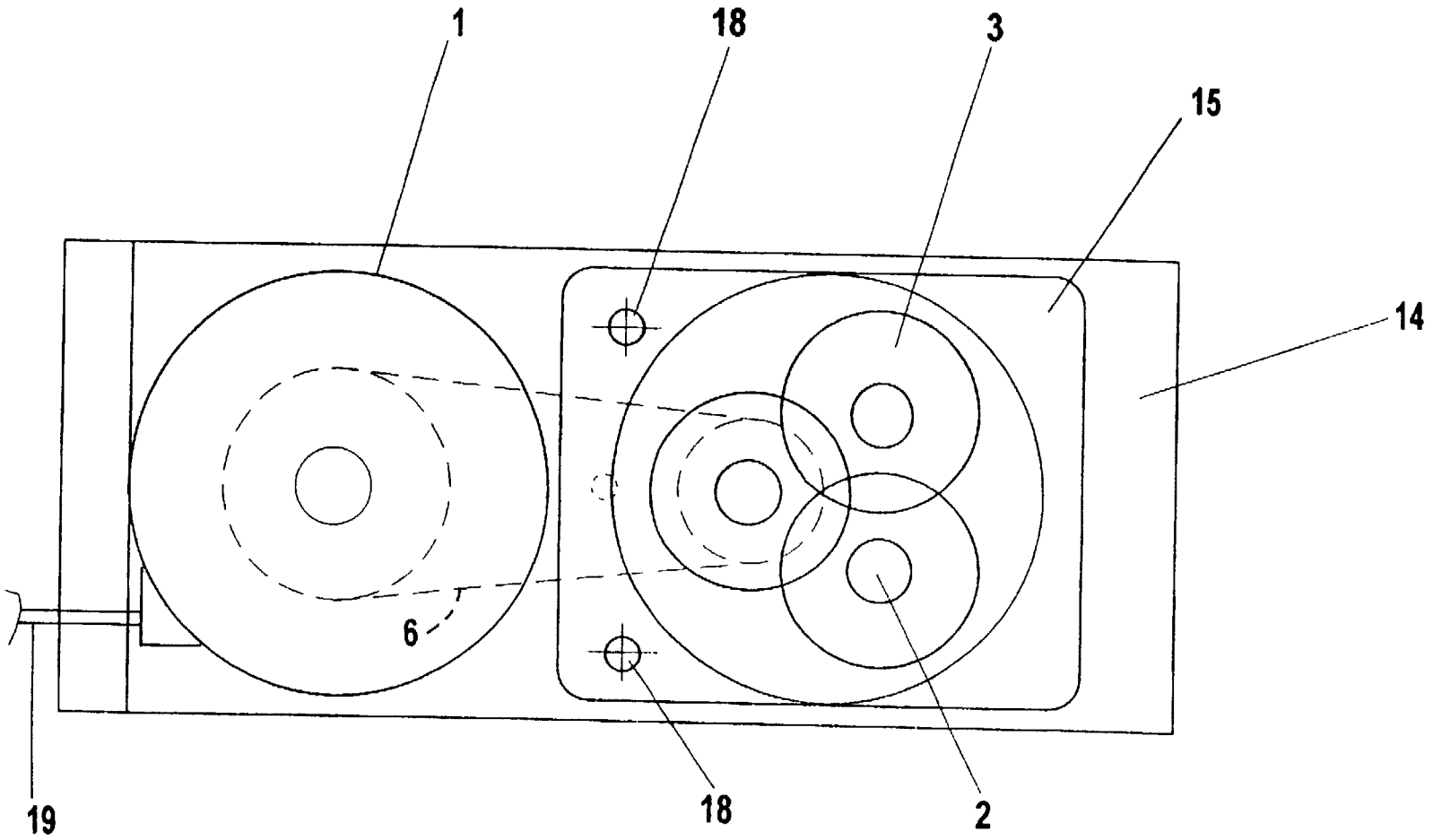
FIG. 3 is a top view of the apparatus shown in FIG. 1.

FIG. 3 is a top view of the complete false twist apparatus. The drive motor 1 is joined with a suitable flange to the one side of base frame 14. The false twist assembly is guided in the axial direction by the two guide pins 18, and it can be moved in the direction of the guide pins 18 when repair, assembly, or exchange work becomes necessary. Shown on spindles 2 are corresponding friction disks 3, which overlap one another. The spindles 2 extending parallel to one another are arranged in an equilateral triangle around the yarn.

Figure 4:
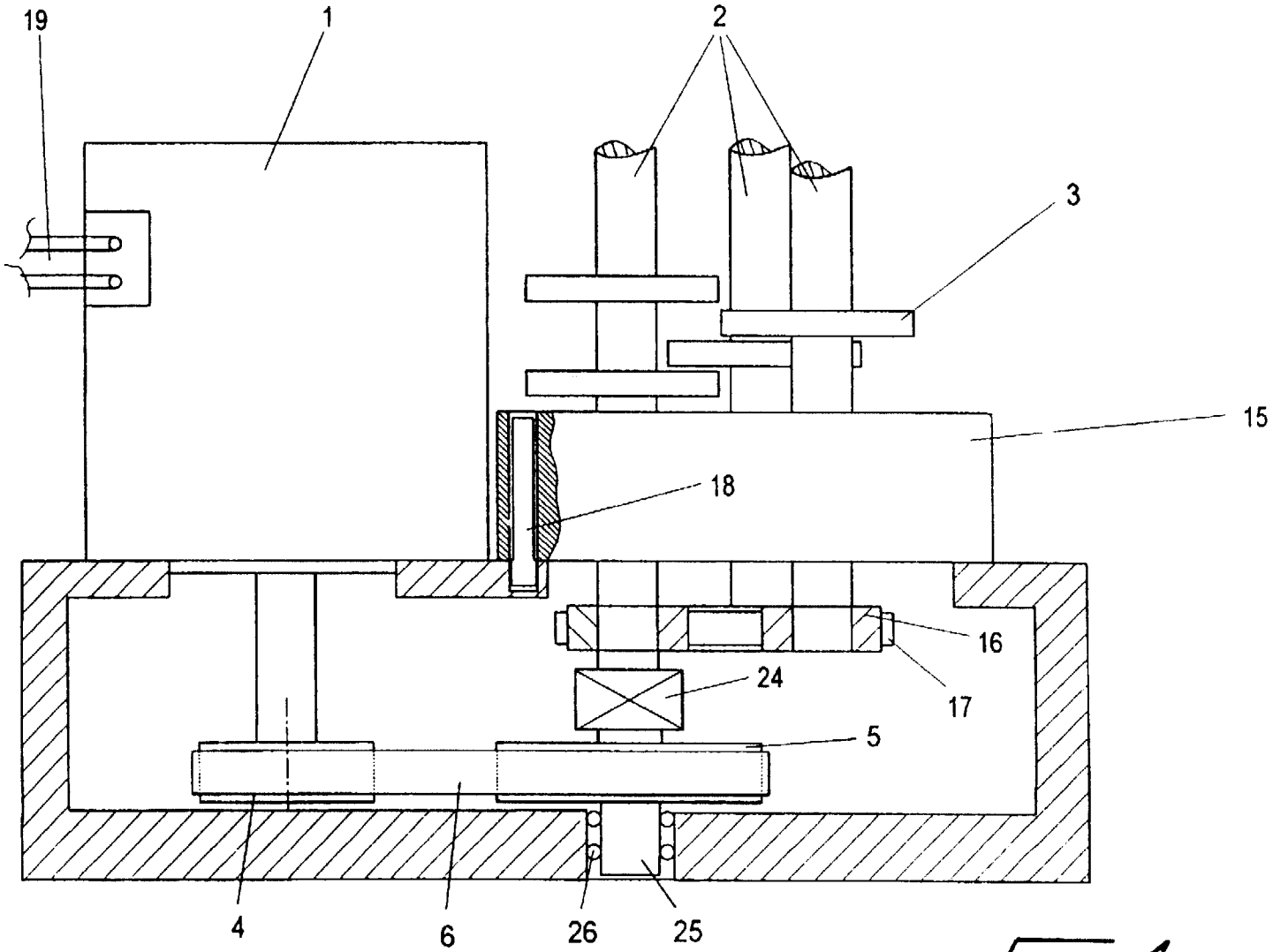
FIG. 4 is a side view, partially sectioned, of a second embodiment of the invention.

A complete false twist apparatus, as shown in FIG. 4, comprises a drive motor 1 with electrical connection lines 19. Arranged next to the motor, is the false twist unit. This false twist assembly is provided with three spindles, which are arranged in the corner points of an equilateral triangle and mounted for rotation in a spindle bearing block 15. Each spindle 2 carries several superposed friction disks 3 which overlap one another, their axes being arranged parallel to one another around an advancing yarn. Arranged on the driven shaft end of drive motor 1 is a motor drive pulley 4. In the same plane as that of motor drive pulley 4, one of the spindles 2 of the friction false twist assembly mounts a belt pulley 5 on its end 25 extending into base frame 14. The belt pulley 5 is driven via a belt 6 by means of drive pulley 4 that is driven by motor 1. The end 25 of the pulley 5 extending into base frame 14 is supported in a bearing 26. Between belt pulley 5 and spindle bearing block 15, each of the spindles 2 is provided with a belt pulley 16, which are positioned in the same plane. A belt 17 which drives pulleys 16, rotates spindles 2 in the same direction and at the same speed. To secure the spindle bearing block 15 in the operative position of the false twist assembly, a guideway is provided, which comprises a pin 18 mounted in base frame 14 and an elongate bore machined out of bearing block 15.

Between belt pulley 5 of the driven spindle 2 and belt pulley 16, the spindle 2 is separated and a clutch 24 is arranged at this point.

Figure 5:
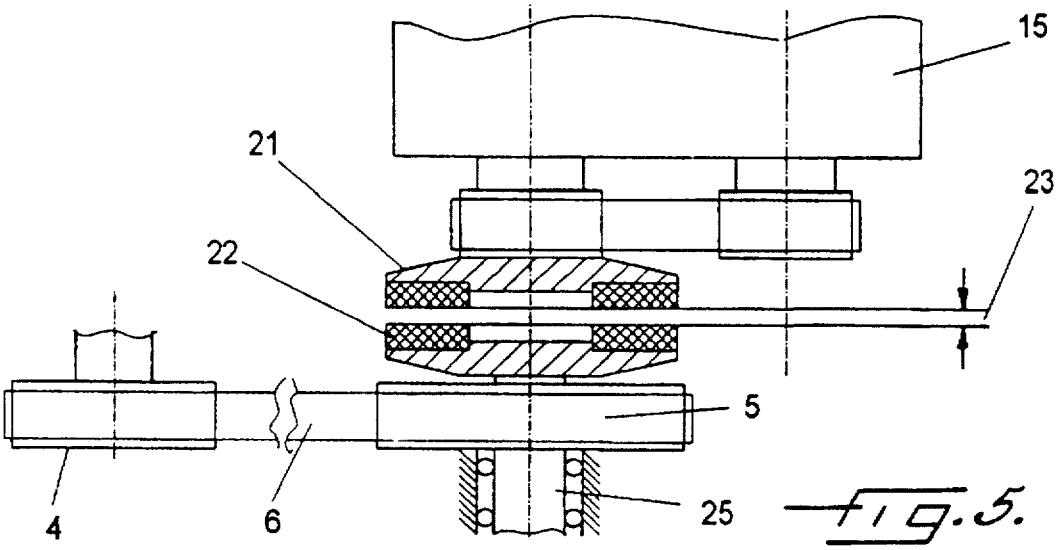
FIG. 5 is a partial side view of a first embodiment of a magnetic clutch.

FIG. 5 illustrates a further preferred embodiment, in which a magnetic clutch is arranged between belt pulley 5 driving one of the three spindles 2 and the belt system circulating in triangular form for driving the spindles 2 of friction disks 3 in the same direction. Thus, the driven spindle of the false twist assembly is separated. Therebetween, two magnetized disks 21, 22 facing each other axially at the front ends with a gap 23 therebetween and having a magnetic polarity alternating in circumferential direction form the magnetic clutch and, thus, represent the actual clutch. Preferably, the spacing between the two magnetic disks is 1 to 3 mm. This separation brings the advantage that the drive belt 6 can be exchanged even without pulling out the false twist assembly from base plate 14, in which the housing is displaceable at any time against the action of force of spring 13, so that the tension of drive belt 6 can be reduced so far as to permit its disengagement from motor drive pulley 4 and drive pulley 5. The cone 8 on belt pulley 5 is not absolutely necessary.

The magnitude of the torque, which can be transmitted by the two magnetized disks 21, 22 facing one another in gap 23, depends on the number of the magnets arranged in the circumferential direction with alternating magnetic polarity.

Moreover, it is also possible that the magnetic clutch has two disks extending in the same plane with a gap therebetween and with a magnetic polarity alternating in the circumferential direction. However, the thus radially opposite disks of the magnetic clutch are limited to the transmission of small torques. The gap between the disks is preferably 1 to 2 mm.

Figure 6:
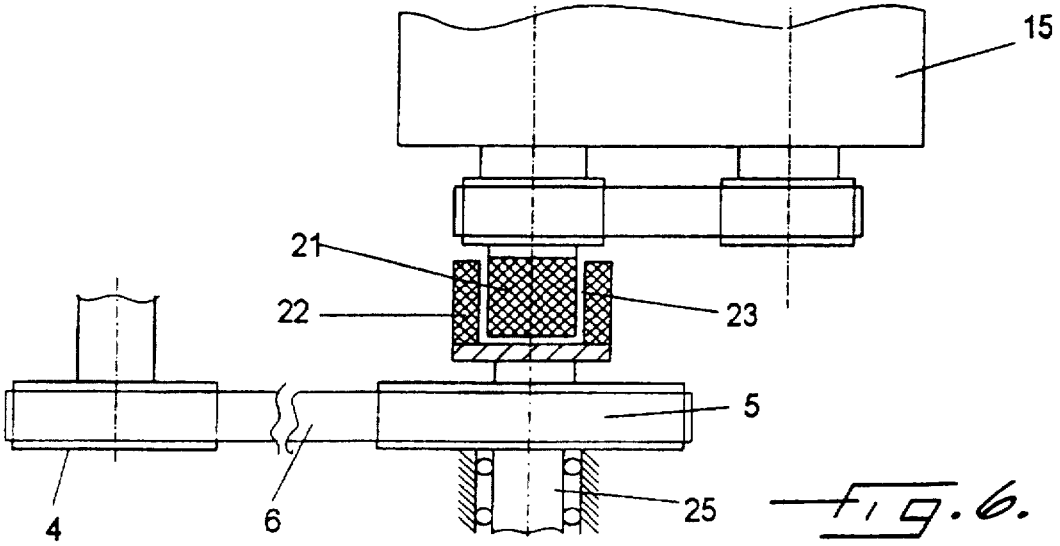
FIG. 6 is partial side view of a second embodiment of a magnetic clutch.

FIG. 6 illustrates a further embodiment of a magnetic clutch 24. This embodiment comprises a first, substantially tubular body 22 and a cylindrical body 21 extending thereinto. The bodies 21, 22 are made coaxial relative to one another, leaving a cylindrical gap 23 therebetween.

Figure 7:
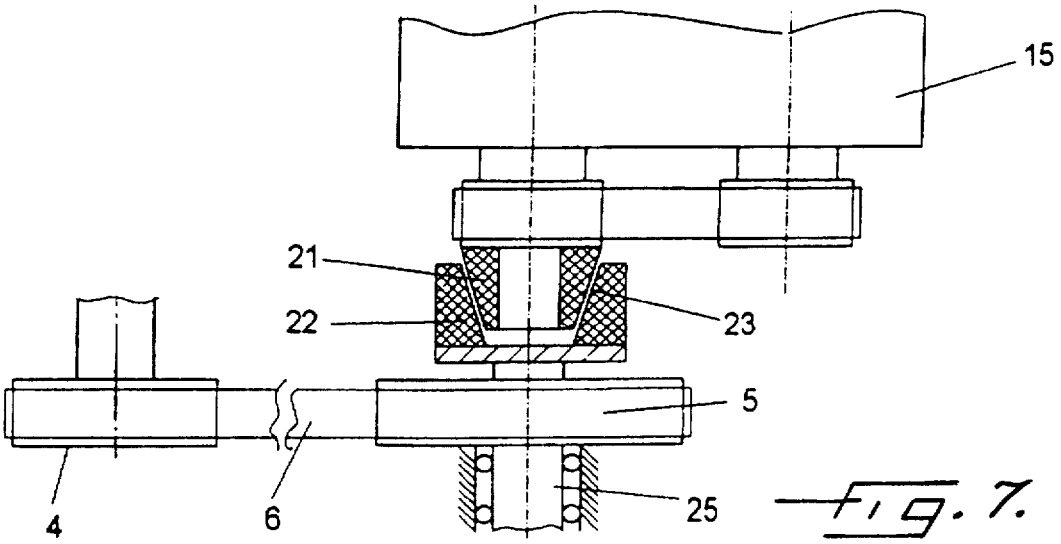
FIG. 7 is a partial side view of a third embodiment of a magnetic clutch.

A further embodiment of a magnetic clutch 24 is shown in FIG. 7. This magnetic clutch has a first body 22 with an internal cone and a second body 21 with an external cone. The surfaces of bodies 21, 22 form between them a peripheral gap 23 corresponding substantially to the envelope of a cone.

That which is claimed is:

1. A yarn false twisting apparatus comprising:

a base frame, a drive motor mounted to said base frame and including an output shaft which defines an output shaft axis, a yarn false twist assembly comprising a bearing block, and at least three spindles mounted to said bearing block for rotation about parallel axes which are positioned at the corner points of an equilateral polygon having a number of sides corresponding to the number of spindles, and a plurality of circular disks mounted on each spindle for rotation therewith, and with the disks of the spindles overlapping at a point centrally between the spindles and defining an operative yarn path of travel extending axially therebetween, means releasably mounting said false twist assembly to said base frame at a fixed distance from said output shaft axis and so that the axes of said spindles are parallel to said output shaft axis, said mounting means comprising at least one guide pin fixed to said base frame and extending in a direction parallel to the output shaft axis, and an opening in said bearing block of said yarn false twist assembly positioned to receive said guide pin, and such that the yarn false twist assembly is able to be separated from said base frame by withdrawing the yarn false twist assembly in a direction parallel to the output shaft axis, and drive transmission means including a drive belt operatively connecting the output shaft of said drive motor to each of said spindles of said yarn false twist assembly so that the drive motor is able to rotate all of the spindles in the same direction, and with the drive transmission means being disconnectable so as to permit the yarn false twist assembly to be removed from the base frame to facilitate the removal and replacement of the drive belt.

2. The yarn false twisting apparatus as defined in claim 1 wherein said drive transmission means comprises a motor drive pulley mounted on said output shaft, a belt pulley mounted on one of said spindles of said yarn false twist assembly, and with said drive belt operatively interconnected about said motor drive pulley and said belt pulley.

3. The yarn false twisting apparatus as defined in claim 2 wherein said motor drive pulley, said belt pulley, and said drive belt all include cooperating drive teeth.

4. The yarn false twisting apparatus as defined in claim 3 wherein said belt pulley includes a conical forward end portion which is coaxial with the one spindle.

5. The yarn false twisting apparatus as defined in claim 4 wherein said conical forward end portion of said belt pulley includes the drive teeth thereon.

6. The yarn false twisting apparatus as defined in claim 2 wherein said drive belt defines a belt plane which is perpendicular to said output shaft axis and the axes of the spindles of the yarn false twist assembly, and further comprising a housing having a bottom wall which is generally parallel to and below the belt plane, and a side wall portion extending upwardly from the bottom wall so as to substantially encompass the motor drive pulley, the belt pulley, and the drive belt.

7. The yarn false twisting apparatus as defined in claim 6 wherein said housing includes a guide edge which extends along at least a portion of the periphery of the belt pulley below the belt plane, for guiding the drive belt on the belt pulley.

8. The yarn false twisting apparatus as defined in claim 7 wherein said housing further includes a guide lip positioned on the side wall portion thereof in a region adjacent the belt pulley and above the belt plane for guiding the drive belt on the belt pulley.

9. The yarn false twisting apparatus as defined in claim 8 wherein the housing is slidably mounted to said base frame so as to be moveable in a direction parallel to the belt plane.

10. The yarn false twisting apparatus as defined in claim 9 wherein said side wall portion of said housing includes an end wall on the side of said motor drive pulley opposite the belt pulley, and wherein the end wall includes an inclined surface extending upwardly from the bottom wall and a shoulder positioned above the inclined surface and which is perpendicular to and aligned with the belt plane.

11. The yarn false twisting apparatus as defined in claim 10 further comprising spring biasing means for biasing the housing in a direction parallel to the plane of the drive belt and extending from said output shaft toward said one spindle.

12. The yarn false twisting apparatus as defined in claim 2 wherein said drive transmission means further comprises a belt pulley system rotatably interconnecting all of said spindles of said yarn false twist assembly, and wherein said one spindle includes a clutch positioned between the belt pulley and the belt pulley system.

13. The yarn false twisting apparatus as defined in claim 12 wherein said clutch is a magnetic clutch comprising two magnetized bodies which face each other with a gap therebetween.

14. The yarn false twisting apparatus as defined in claim 13 wherein the magnetized bodies of said clutch are configured such that the gap therebetween is disk-shaped.

15. The yarn false twisting apparatus as defined in claim 13 wherein the magnetized bodies of said clutch are configured such that the gap is cylindrical.

16. The yarn false twisting apparatus as defined in claim 13 wherein the magnetized bodies of said clutch are configured such that the gap is conical.

17. The yarn false twisting apparatus as defined in claim 13 wherein the magnetized bodies of said clutch have an alternating magnetic polarity.

18. A yarn false twisting apparatus comprising:

a base frame, a drive motor mounted to said base frame and including an output shaft which defines an output shaft axis, a yarn false twist assembly comprising a bearing block, and at least three spindles mounted to said bearing block for rotation about parallel axes which are positioned at the corner points of an equilateral polygon having a number of sides corresponding to the number of spindles, and a plurality of circular disks mounted on each spindle for rotation therewith, and with the disks of the spindles overlapping at a point centrally between the spindles and defining an operative yarn path of travel extending axially therebetween, means releasably mounting said false twist assembly to said base frame at a fixed distance from said output shaft axis and so that the axes of said spindles are parallel to said output shaft axis, said mounting means comprising at least one elongate guide pin fixed to one of said base frame and said bearing block of said yarn false twist assembly and extending in a direction parallel to the output shaft axis, and an elongate opening in the other of said base frame and said bearing block of said yarn false twist assembly and slideably receiving said guide pin, and such that the yarn false twist assembly is able to be separated from said base frame by withdrawing the yarn false twist assembly in a direction parallel to the output shaft axis, and drive transmission means including a drive belt operatively connecting the output shaft of said drive motor to each of said spindles of said yarn false twist assembly so that the drive motor is able to rotate all of the spindles in the same direction, and with the drive transmission means being disconnectable so as to permit the yarn false twist assembly to be removed from the base frame to facilitate the removal and replacement of the drive belt.

19. The yarn false twisting apparatus as defined in claim 18 wherein said drive transmission means comprises a motor drive pulley mounted on said output shaft, a belt pulley mounted on one of said spindles of said yarn false twist assembly, and with said drive belt operatively interconnected about said motor drive pulley and said belt pulley.

20. The yarn false twisting apparatus as defined in claim 19 wherein said drive belt defines a belt plane which is perpendicular to said output shaft axis and the axes of the spindles of the yarn false twist assembly, and further comprising a housing for supporting the drive belt in said belt plane upon withdrawal of the false twist assembly from said base frame.

21. The yarn false twisting apparatus as defined in claim 20 wherein said housing is slideably mounted to said base frame so as to be movable in a direction parallel to the belt plane upon withdrawal of the false twist assembly from said base frame and so as to cause the drive belt to disengage from the motor drive pulley.

22. The yarn false twisting apparatus as defined in claim 21 wherein said belt pulley includes a conical forward end portion which is coaxial with the one spindle so as to facilitate entry of the drive belt onto the belt pulley upon assembly of the false twist assembly onto the base frame.

* * * * *